US010264882B1

(12) United States Patent
Lai

(10) Patent No.: US 10,264,882 B1
(45) Date of Patent: Apr. 23, 2019

(54) ALUMINUM ALLOY CABINET BOARD

(71) Applicant: REFINE SCIENTIFIC CO., LTD., Changhua County (TW)

(72) Inventor: Sung-Li Lai, Changhua County (TW)

(73) Assignee: Refine Scientific Co., Ltd., Changhua County (TW)

( * ) Notice: Subject to any disclaimer, the term of this patent is extended or adjusted under 35 U.S.C. 154(b) by 0 days.

(21) Appl. No.: 16/047,363

(22) Filed: Jul. 27, 2018

(30) Foreign Application Priority Data

Oct. 12, 2017 (TW) ..... 106215018 U

(51) Int. Cl.
*A47F 7/00* (2006.01)
*A47B 96/04* (2006.01)
*A47B 96/14* (2006.01)

(52) U.S. Cl.
CPC ..... *A47B 96/04* (2013.01); *A47B 96/1433* (2013.01)

(58) Field of Classification Search
CPC ..... A47B 96/04; A47B 96/1433; A47B 2096/207; A47B 2220/0052; A47B 2220/0058; A47B 96/26; A47B 96/205
USPC ..... 52/36.5, 285.1, 790.1, 787.1, 783.1, 52/223.6, 223.7; 248/200.1, 200, 694, 248/235; 108/108; 211/189, 182, 183, 211/187, 87.01, 191
See application file for complete search history.

(56) References Cited

U.S. PATENT DOCUMENTS 1,136,792 A * 4/1915 Goldsmith ..... E04B 2/22 52/352
2,343,833 A * 3/1944 Pinson ..... B63B 19/14 114/201 R
2,983,080 A * 5/1961 Whiteside ..... E04B 2/845 52/361
3,034,609 A * 5/1962 Young ..... E04B 2/7872 52/220.7
3,209,709 A * 10/1965 Shoffner ..... A47F 5/103 108/108
3,281,510 A * 10/1966 Lovret ..... B29C 44/30 264/209.2
3,346,124 A * 10/1967 Sobel ..... A47B 47/03 108/108
3,394,507 A * 7/1968 Doke ..... E04B 2/7854 108/107
3,403,492 A * 10/1968 Dudley ..... E04H 4/0081 4/DIG. 9
3,407,547 A * 10/1968 Doke ..... E04B 2/7854 248/243
3,464,170 A * 9/1969 Grover ..... E04B 2/7448 52/127.7

(Continued)

*Primary Examiner* — Jonathan Liu
*Assistant Examiner* — Devin K Barnett
(74) *Attorney, Agent, or Firm* — Rosenberg, Klein & Lee

(57) ABSTRACT

An aluminum alloy cabinet board is revealed. A plurality of cabinet boards can be assembled into a cabinet assembly. The cabinet board includes a central plate, two lateral base plates and a plurality of cover plates. A hollow part is penetrating through the lateral base plate and a reinforcement tube is mounted into the hollow part. A plurality of pressing bolts is passed through the central plate and the two lateral base plates for fastening and positioning firmly. Thereby the structural strength of the whole cabinet board is improved. The design of the cabinet board also prevents insects from getting therein so that the cabinet board is insect resistant.

3 Claims, 4 Drawing Sheets

(56) References Cited

U.S. PATENT DOCUMENTS 3,488,904 A * 1/1970 Dawdy ..... E04B 2/7401 428/457
3,509,669 A * 5/1970 Plemeng ..... A47B 96/1416 52/36.6
3,562,970 A * 2/1971 Schwartz ..... A47B 57/00 248/243
3,598,066 A * 8/1971 Polezoes ..... A47B 57/16 108/108
3,685,234 A * 8/1972 Nelsson ..... A47B 96/1416 108/108
3,714,748 A * 2/1973 Costruba ..... A47B 96/1416 108/108
3,844,231 A * 10/1974 Peacock ..... A47B 57/42 108/107
RE28,408 E * 5/1975 Nelsson ..... A47B 96/1416 108/108
4,055,253 A * 10/1977 Oztekin ..... A47F 5/103 108/108
4,055,920 A * 11/1977 Becker ..... E04C 2/365 52/2.26
4,067,165 A * 1/1978 Timmons ..... E04B 2/7425 52/238.1
4,100,709 A * 7/1978 Good ..... E04B 2/7427 160/135
4,108,085 A * 8/1978 Shepherd ..... A47F 5/103 108/108
4,186,666 A * 2/1980 Honickman ..... A47B 47/021 108/107
4,290,246 A * 9/1981 Hilsey ..... E02D 27/02 52/125.3
4,420,087 A * 12/1983 Johns ..... A47F 5/0846 211/189
4,428,174 A * 1/1984 Grady, II ..... E04B 2/72 52/223.7
4,429,505 A * 2/1984 Fischer ..... A01G 9/1407 52/584.1
4,459,790 A * 7/1984 Vermillion ..... E04B 2/825 52/241
4,486,993 A * 12/1984 Graham ..... E04B 1/76 52/223.7
4,588,156 A * 5/1986 Doke ..... E04B 2/74 248/243
4,588,190 A * 5/1986 Stewart ..... A63B 69/0097 273/395
4,651,484 A * 3/1987 Rutkowski ..... E04B 2/7457 52/241
4,726,163 A * 2/1988 Jacobs ..... B28B 23/043 264/228
5,048,254 A * 9/1991 Merlau ..... E04C 2/384 52/235
5,205,421 A * 4/1993 Bustos ..... A47F 5/005 108/108
5,209,035 A * 5/1993 Hodges ..... E04B 2/7425 52/220.7
5,464,103 A * 11/1995 O'Brien ..... A47B 57/20 211/133.3
5,517,795 A * 5/1996 Doke ..... A47B 96/1416 248/243
5,566,844 A * 10/1996 Bernardin ..... A47F 5/0846 211/162
5,638,644 A * 6/1997 Bastian ..... A47B 57/30 403/363
5,642,593 A * 7/1997 Shieh ..... E04B 2/7424 160/130
5,678,373 A * 10/1997 Franklin ..... E04B 2/14 52/223.7
5,746,035 A * 5/1998 Seiber ..... A47B 57/425 52/238.1
6,024,230 A * 2/2000 Menaged ..... A47F 5/0807 211/103
6,027,192 A * 2/2000 Irace ..... A47B 47/02 312/205
6,029,831 A * 2/2000 Miller ..... E04B 2/7425 211/182
6,079,174 A * 6/2000 Williams ..... E04B 2/827 52/126.3
6,164,467 A * 12/2000 DePottey ..... A47F 5/0846 211/189
6,230,445 B1 * 5/2001 Arko ..... E04B 2/7416 211/90.02
6,385,937 B1 * 5/2002 Alexandre ..... E04B 2/707 52/127.2
6,511,567 B1 * 1/2003 Ruggie ..... E04C 2/3405 156/205
6,612,077 B2 * 9/2003 Parshad ..... E04B 2/7422 160/351
6,786,014 B2 * 9/2004 Kishimoto ..... E04B 2/7448 52/220.7
6,883,277 B2 * 4/2005 Wiechecki ..... E04B 2/7427 52/238.1
7,137,226 B2 * 11/2006 Fiutak ..... B27M 3/0053 52/223.7
7,143,564 B2 * 12/2006 Renck ..... E04C 2/16 52/783.17
7,185,460 B2 * 3/2007 Corden ..... E04B 2/7453 52/220.7
7,373,760 B2 * 5/2008 Tokuno ..... E01D 19/125 14/73
7,520,100 B1 * 4/2009 Herrman ..... E04B 2/7457 52/238.1
7,676,992 B2 * 3/2010 Burns ..... E04F 13/081 52/35
8,028,846 B2 * 10/2011 Peota ..... A47B 91/00 108/108
8,091,317 B2 * 1/2012 Brackett ..... E04C 5/02 411/250
8,307,608 B2 * 11/2012 Harig ..... B67D 7/0272 52/481.1
8,522,508 B1 * 9/2013 Collins ..... E04B 1/7046 52/209
8,959,859 B2 * 2/2015 Haan ..... E05B 65/006 52/309.1
9,032,682 B2 * 5/2015 Knoll ..... E04C 2/34 52/238.1
D747,262 S * 1/2016 Cai ..... D13/102
9,315,986 B2 * 4/2016 Oliveira ..... E04B 2/789
9,326,600 B1 * 5/2016 Reynolds ..... A47B 47/00
10,058,173 B2 * 8/2018 Umstead ..... A47B 57/545
2002/0088188 A1 * 7/2002 Chang ..... F21V 33/0032 52/238.1
2002/0121071 A1 * 9/2002 Heung-Bin ..... E06B 7/23 52/800.11
2003/0094427 A1 * 5/2003 Suttles ..... A47B 55/02 211/187
2004/0055514 A1 * 3/2004 De Land ..... A47B 96/04 108/108
2004/0128925 A1 * 7/2004 Massey ..... E06B 1/6092 52/204.1
2005/0204698 A1 * 9/2005 Werner ..... B32B 7/00 52/783.1
2006/0272245 A1 * 12/2006 Matsufuji ..... E04B 2/16 52/223.7
2008/0104906 A1 * 5/2008 Pyo ..... B28B 5/028 52/223.7
2009/0015122 A1 * 1/2009 Ho ..... A47B 47/042 312/265.5
2009/0320407 A1 * 12/2009 Johansson ..... E04B 2/7457 52/746.1
2012/0272596 A1 * 11/2012 Ladvie ..... E04B 2/06 52/223.7
2012/0304515 A1 * 12/2012 Ceurvels ..... G09F 15/0068 40/605
2012/0324811 A1 * 12/2012 Kawase ..... H05K 9/0003 52/223.6
2013/0247495 A1 * 9/2013 Tancredi ..... E04F 13/0862 52/479
2013/0264924 A1 * 10/2013 Tusk ..... A47B 47/0041 312/265.4

(56) References Cited

U.S. PATENT DOCUMENTS

| | | | | |
|---|---|---|---|---|
| 2013/0295317 | A1* | 11/2013 | Wu | A47B 96/205<br>428/99 |
| 2014/0109473 | A1* | 4/2014 | Sung | A01G 9/025<br>47/39 |
| 2014/0137492 | A1* | 5/2014 | French | B28B 7/186<br>52/223.6 |
| 2014/0259831 | A1* | 9/2014 | Denby | A47F 5/10<br>40/606.03 |
| 2015/0211242 | A1* | 7/2015 | Rosati | E04G 21/3247<br>414/10 |
| 2016/0168863 | A1* | 6/2016 | Kwan | E04F 13/0805<br>52/36.5 |
| 2016/0186790 | A1* | 6/2016 | Poradzisz | E04F 11/1812<br>248/314 |
| 2016/0305131 | A1* | 10/2016 | Schock | F16M 13/02 |
| 2016/0380581 | A1* | 12/2016 | Kawakatsu | H02S 30/10<br>136/251 |

* cited by examiner

ALUMINUM ALLOY CABINET BOARD

BACKGROUND OF THE INVENTION

Field of the Invention

The present invention relates to an aluminum alloy cabinet board, especially to an aluminum alloy cabinet board that is having a higher structural strength, insect resistant and able to be assembled into a cabinet assembly conveniently.

Description of Related Art

Storage cabinets are broadly used in our daily lives. Most of cabinets are manufactured in the factory and then delivered to the customer's home. However, the cabinets are difficult to handle and transport owing to its volume. Thus the cabinets become versatile and users can get the cabinets from the store, transport the cabinets to their home, and set the cabinets at a specific place. Then the cabinets are assembled with threaded fasteners by themselves.

Although the above cabinets are convenient to transport, they still have certain shortcomings in practice. Generally, a cabinet board is formed by a plurality of panels with various lengths connected. Then a customized cabinet is produced by the cabinet boards. Moreover, an inner surface at one side of the cabinet board is usually drilled to have several insertion holes in advance. The insertion hole is used for mounting a positioning pin. The positioning pins are driven into the insertion holes located at the height required for loading a partition. Yet the insertion holes without the positioning pins are easy to collect dirt and dust. Sometimes bugs may be hiding therein. The central part of the cabinet is easy to have deformation after objects being placed thereon when the cabinet board is long, even there are some cover plates being arranged at the top and the lateral sides thereof for increasing the strength thereof. The appearance of the cabinet is damaged and aesthetics is affected. The product value is further reduced.

Thus there is room for improvement and there is a need to provide a novel cabinet board that overcomes shortcomings of the structure available now.

SUMMARY OF THE INVENTION

Therefore it is a primary object of the present invention to provide an aluminum alloy cabinet board that is having a higher structural strength, insect-resistant and able to be assembled into a cabinet assembly.

In order to achieve the above object, an aluminum alloy cabinet board according to the present invention includes a central plate, two lateral base plates and a plurality of cover plates. Each lateral base plate includes a hollow part penetrating therethrough and a reinforcement tube is mounted into the hollow part. A plurality of pressing bolts is passed through the central plate and the two lateral base plates for fastening and positioning them firmly. Thereby the structural strength of the whole cabinet board is improved. At the same time, the design of the cabinet board prevents insects from getting therein. Thus the cabinet board is insect resistant.

Preferably, the cabinet board is made from aluminum alloy.

Preferably, each lateral base plate includes a mounting part and a locking part on two sides thereof respectively while the central plate has an assembling part on each of two sides thereof. The locking parts are connected to the assembling parts so as to join the lateral base plates with the central plate.

Compared with the cabinet board available now, the present invention has the following advantages:

1. The reinforcement tubes are mounted into the hollow parts of the lateral base plates respectively and then pressing bolts are passed through the lateral base plates and the reinforcement tubes for fastening them. Thus the structural strength of the whole cabinet board is improved.
2. The preset holes of the lateral base plate are covered by the reinforcement tube so as to prevent insects from entering the cabinet board and provide insect-resistance.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn techniques, features and functions of the present invention clearly, please refer to the following embodiments, related figures and reference numbers.

Figure 1:
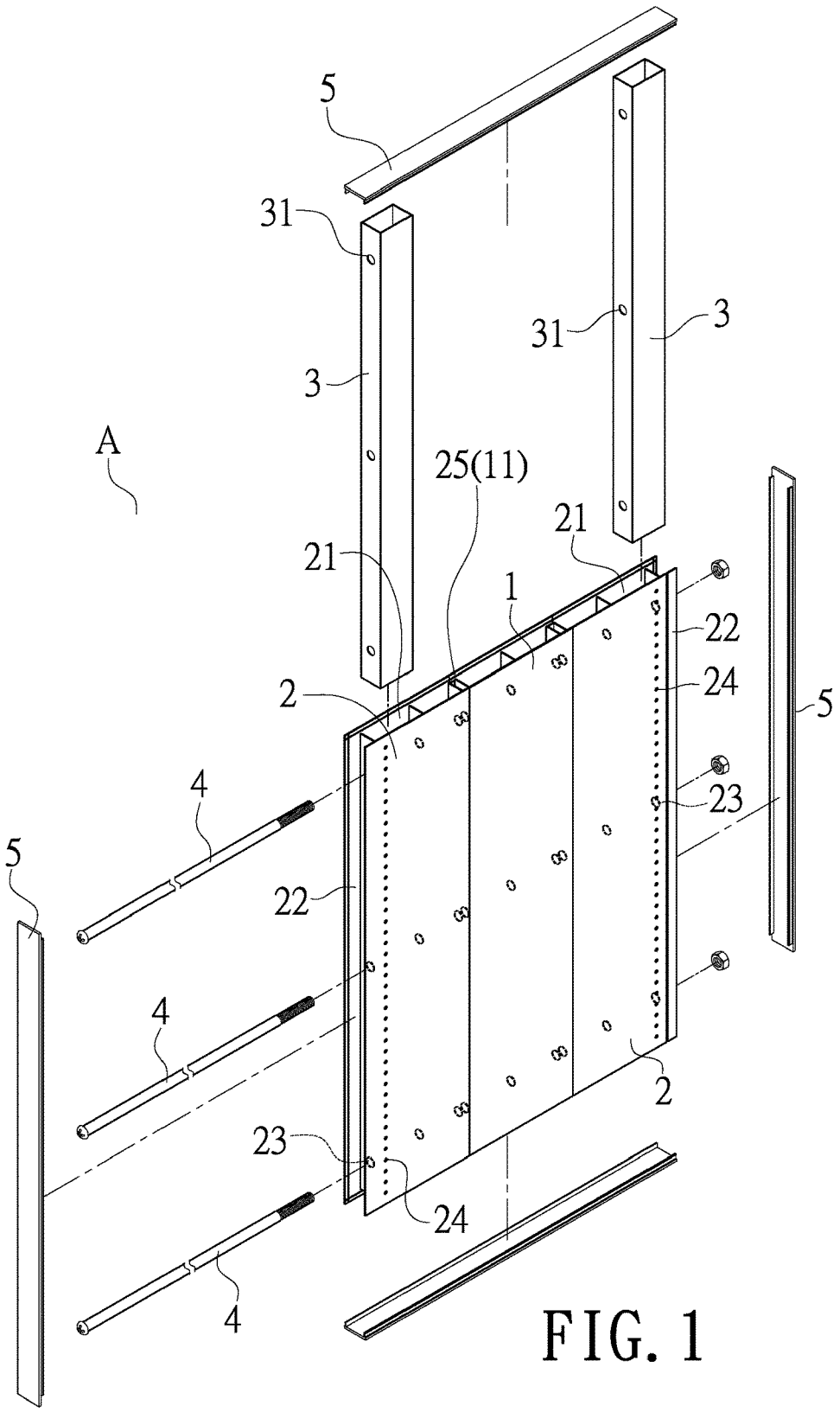
FIG. 1 is an explosive view of an embodiment according to the present invention.
Figure 2:
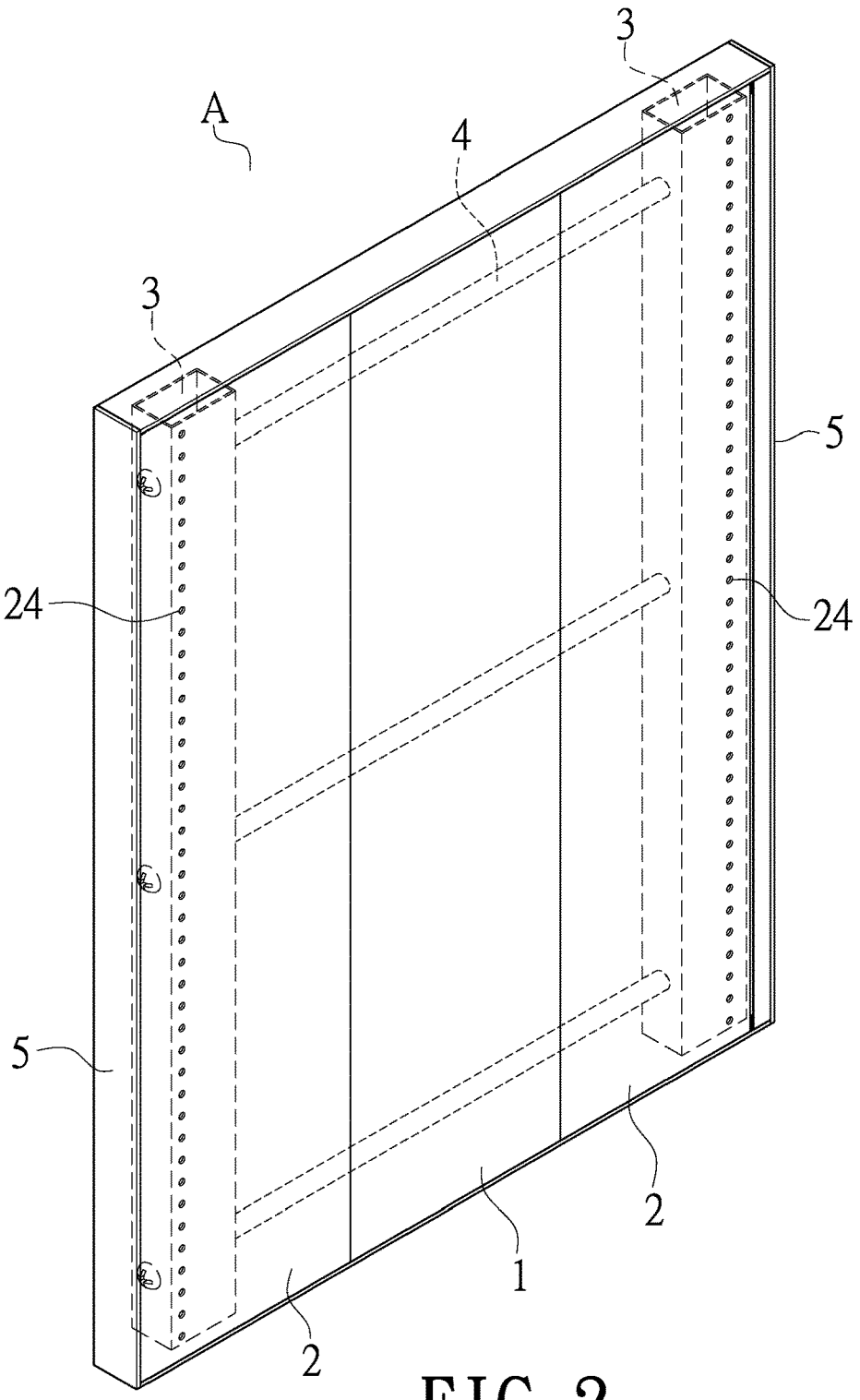
FIG. 2 is a schematic drawing showing an assembled embodiment according to the present invention.
Figure 3:
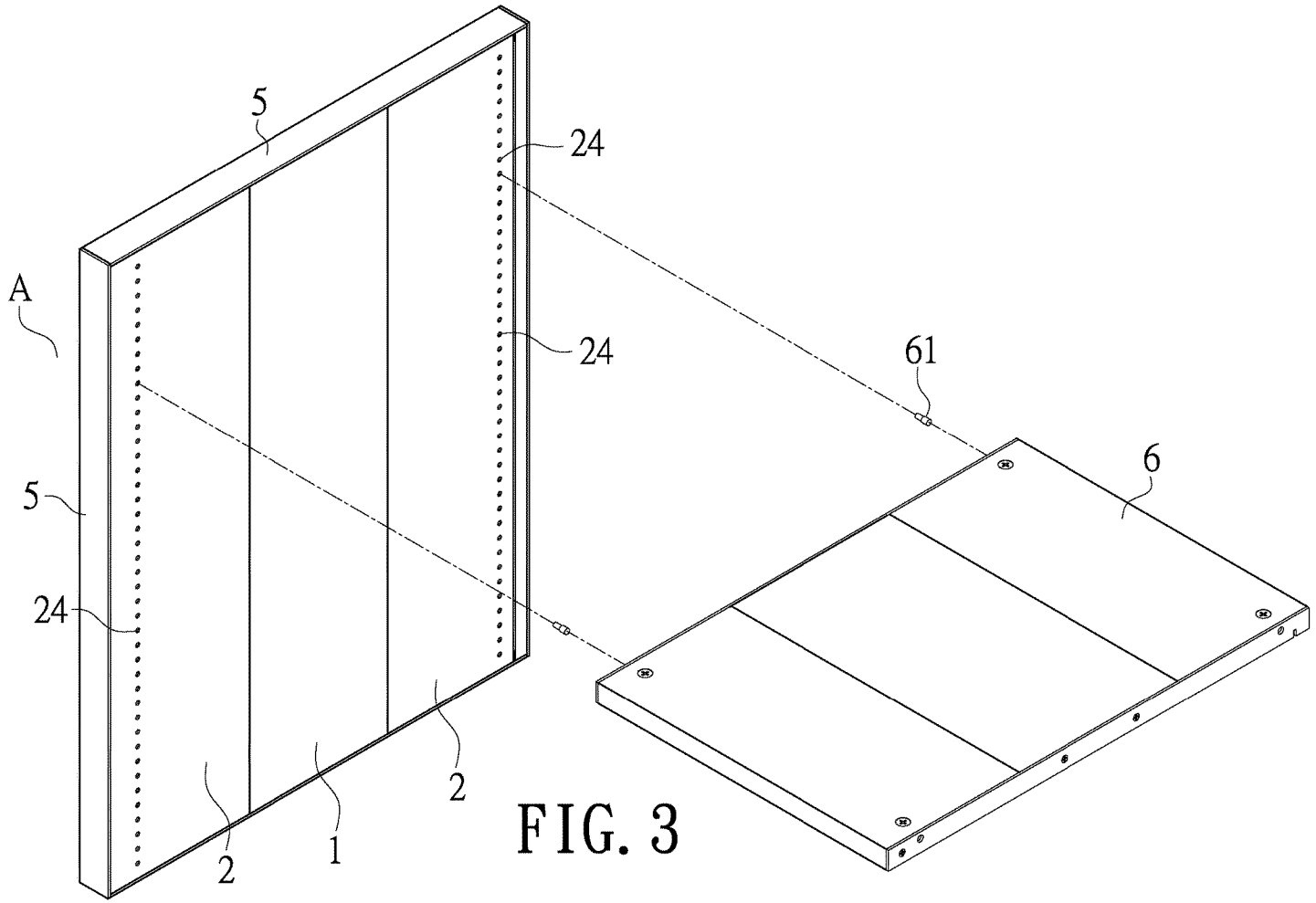
FIG. 3 is a schematic drawing showing a partition being assembled with an embodiment according to the present invention.

Refer to FIG. 1, a cabinet assembly is formed by a plurality of cabinet boards (A) being assembled and each cabinet board (A) includes a central plate 1, two lateral base plates 2 disposed on two sides of the central plate 1 respectively, two reinforcement tubes 3, a plurality of pressing bolts 4, and a plurality of cover plates 5.

Each of the lateral base plates 2 consists of a hollow part 21 penetrating therethrough, a mounting part 22 on one side thereof opposite to the side thereof connected to the central plate 1, a plurality of fastening holes 23 arranged at the mounting part 22, and a plurality of preset holes 24 set on a surface of one side of the hollow part 21.

The reinforcement tube 3 is mounted into the hollow part 21 and the preset holes 24 are covered by the reinforcement tube 3. A plurality of insertion holes 31 corresponding to the fastening holes 23 is disposed on the reinforcement tube 3.

The pressing bolt 4 is passed through the fastening holes 23 and the insertion holes 31 correspondingly for fastening and positioning the central plate 1 and the two lateral base plates 2.

The cover plates 5 are set on the mounting part 22 of each lateral base plate 2, a top and a bottom of the connected central plate 1 and each lateral base plates 2 respectively.

While being assembled, the central plate 1 can be formed by a single lumber or a plurality of lumbers according to the length required. The central plate 1 has an assembling part 11 on each of two sides thereof while the lateral base plate 2 includes the mounting part 22 and a locking part 25 on two sides thereof respectively. The locking part 25 is corresponding to the assembling part 11 of the central plate 1. The locking parts 25 of the lateral base plates 2 are connected to the assembling parts 11 of the central plate 1 correspondingly so that the lateral base plates 2 and the central plate 1 are joined together.

Then each of the reinforcement tubes 3 is mounted into the hollow part 21 of the lateral base plate 2 correspondingly and the preset holes 24 are covered by the reinforcement tube 3. Next the pressing bolt 4 is passed through the fastening holes 23 and the insertion holes 31 for fastening and positioning the central plate 1 and the two lateral base plates 2. Lastly the cover plates 5 are arranged at the mounting part 22 of the lateral base plate 2, a top and a bottom of the connected central plate 1 and the lateral base plates 2 respectively. Thereby the central plate 1 and the lateral base plates 2 are connected and positioned firmly. The structural strength of the whole cabinet board is improved.

Figure 4:
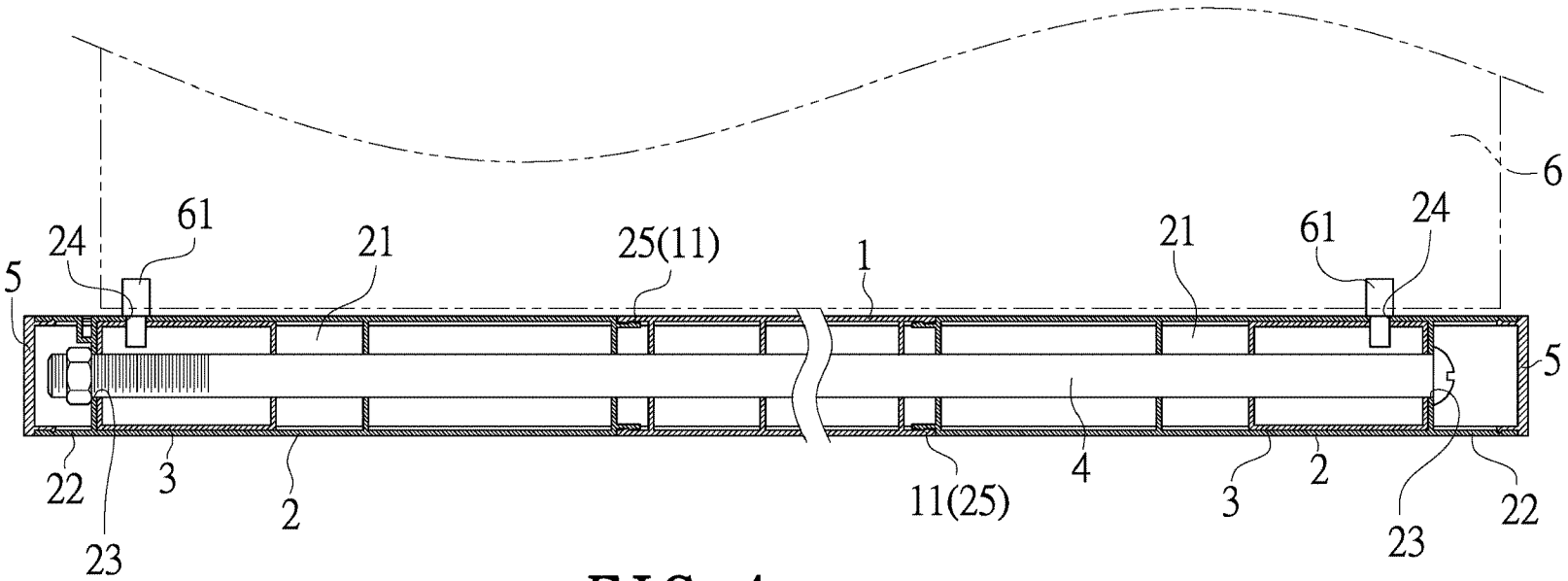
FIG. 4 is a schematic drawing showing a sectional view of an embodiment according to the present invention.

As shown in FIG. 4, two positioning parts 61 are driven into the preset holes 24 and mounted into the reinforcement tubes 3 directly for assembly of a partition 6. Then the partition 6 is placed on the positioning parts 61 more stably.

In summary, the present invention has the following advantages compared with the structure available now:

1. The structural strength of the whole cabinet board is enhanced by the reinforcement tubes mounted into the hollow parts of the lateral base plates respectively and the pressing bolts passed through the lateral base plates and the reinforcement tubes respectively.
2. The preset holes of the lateral base plate are covered by the reinforcement tube. Thus no bugs will hide in the cabinet board and the cabinet is insect-resistant.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A cabinet board used to form a cabinet assembly comprising:

a central wall, wherein the central wall comprises a front central plate and a rear central plate that is parallel to and spaced apart from the front central plate;

two lateral walls each disposed on opposite sides of the central wall respectively; wherein the lateral walls each have a front lateral plate and a rear lateral plate parallel to and spaced apart from the front lateral plate respectively; wherein a plurality of inner divider walls extend between and connect each front plate and each rear plate of the central wall and the lateral walls respectively to form vertical hollow channels within the central wall and the lateral walls respectively; wherein at least two vertical hollow channels from said vertical channels each have a first width, the first width is defined between a corresponding pair of adjacent inner divider walls from said plurality of divider walls; wherein a plurality of fastening holes are formed through each of the inner divider walls; wherein a plurality of preset holes are formed in each of the lateral front plates respectively;

at least two rectangular reinforcement tubes that strengthen the cabinet board, wherein each reinforcement tube is inserted within a corresponding vertical hollow channel from said at least two vertical hollow channels; wherein each reinforcement tube has a front side, a rear side, opposed side walls, and a hollow interior; wherein each reinforcement tube has a second width; wherein the second width is greater than half the width of the first width so that each reinforcement tube occupies a majority of each of the at least two vertical hollow channels respectively; wherein a plurality of insertion holes are formed through each reinforcement tube, wherein the insertion holes are aligned with and correspond to the fastening holes respectively;

a plurality of threaded pressing bolts that is passed through correspondingly aligned fastening holes and the insertion holes respectively for fastening the two lateral walls, the central wall, and each of the reinforcement tubes to each other; and a plurality of cover plates that cover a top and a bottom of the connected central wall and the lateral walls respectively and covers a distal end of each of the lateral walls respectively.

2. The cabinet board as claimed in claim 1, wherein the plurality of inner divider walls includes two assembling parts disposed within the central wall and a locking part disposed with each lateral wall respectively, wherein each locking part corresponds to and connects with a corresponding assembling part from said two assembling parts.

3. The cabinet board as claimed in claim 2, wherein a positioning part is driven into a corresponding preset hole from said plurality of preset holes and mounted into a corresponding reinforcement tube from said at least two reinforcement tubes for securing a partition to the cabinet board.

* * * * *